United States Patent [19]

Thompson

[11] 4,169,782

[45] Oct. 2, 1979

[54] VISBREAKING PROCESS

[75] Inventor: H. Lytle Thompson, Park Ridge, Ill.

[73] Assignee: UOP Inc., Des Plaines, Ill.

[21] Appl. No.: 867,548

[22] Filed: Jan. 6, 1978

[51] Int. Cl.[2] ..... C10G 37/00

[52] U.S. Cl. ..... 208/102; 208/48 Q; 208/104

[58] Field of Search ..... 208/102, 103, 104, 105, 208/48 Q

[56] References Cited

U.S. PATENT DOCUMENTS

| | | | |
|---|---|---|---|
| 1,956,856 | 5/1934 | Cook | 208/105 |
| 2,002,160 | 5/1935 | Throckmorton | 208/103 |
| 2,045,458 | 6/1936 | Gary et al. | 208/103 |

*Primary Examiner*—Herbert Levine

*Attorney, Agent, or Firm*—James R. Hoatson, Jr.; John F. Spears, Jr.; William H. Page, II

[57] ABSTRACT

A process for visbreaking a heavy petroleum fraction wherein the effluent of the visbreaking heater is quenched by admixture with an overhead liquid produced by condensation of the overhead vapors of a secondary flash zone. The visbreaker effluent is then passed into a rectified flash zone, with the bottoms liquid of the rectified flash zone forming the feed stream to the secondary flash zone.

3 Claims, 1 Drawing Figure

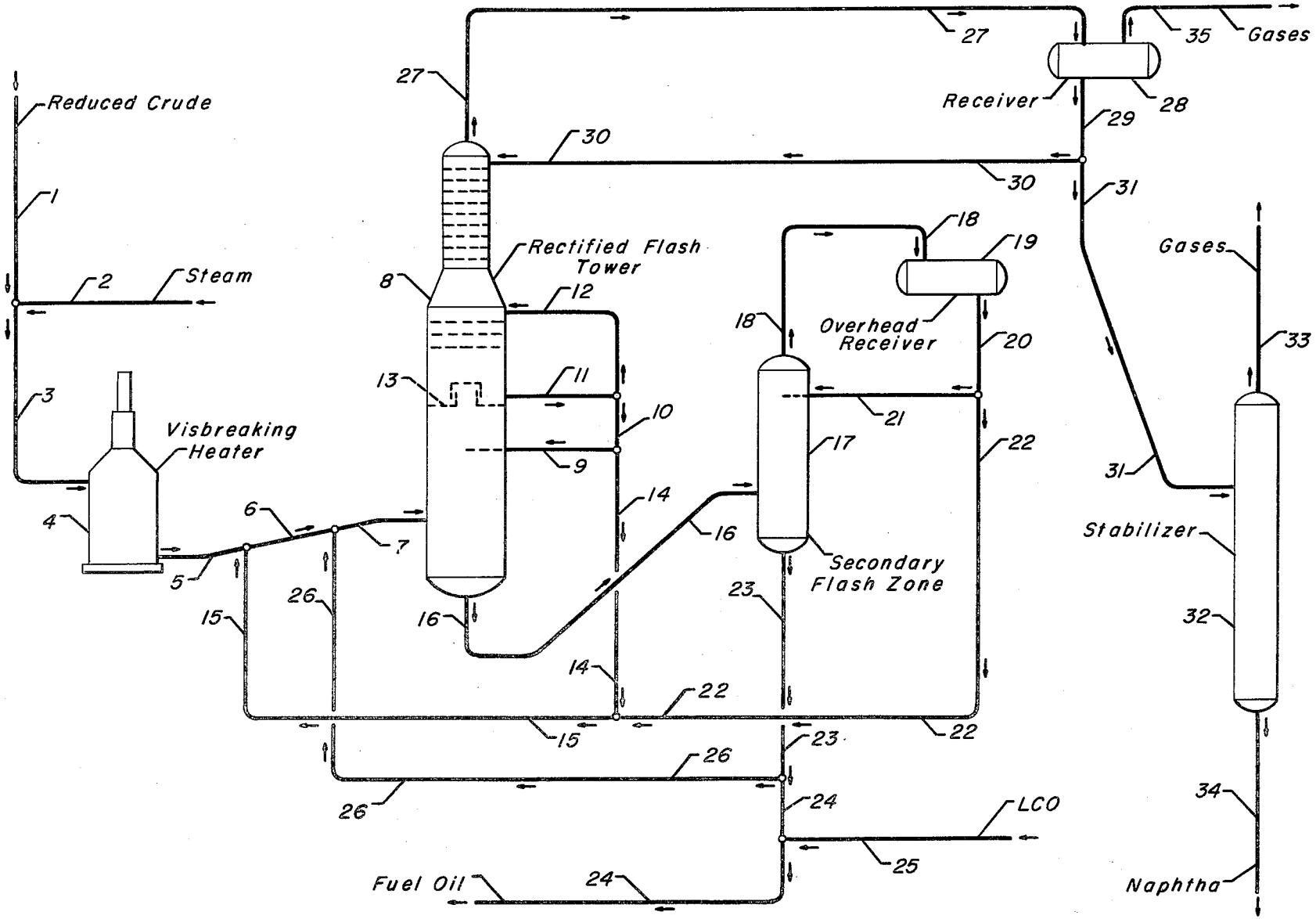
Gases
Gases
Stabilizer
Naphtha
Receiver
Overhead Receiver
Secondary Flash Zone
LCO
Rectified Flash Tower
Fuel Oil
Steam
Visbreaking Heater
Reduced Crude

VISBREAKING PROCESS

FIELD OF THE INVENTION

The invention relates to a process for refining mineral oils, such as vacuum reduced crude oils. The invention more specifically relates to a process for thermally treating heavy hydrocarbonaceous oils commonly referred to as visbreaking. References concerned with similar subject matter may be found, for instance, in Class 208.

PRIOR ART

Visbreaking is one of the older petroleum refining processes, and the visbreaking art is therefore fairly well developed. The integration of a visbreaking process into a refinery is shown in U.S. Pat. No. 2,366,218. The use of visbreaking is also shown in U.S. Pat. No. 2,762,754.

It is known in the art that it is desirable to quench the effluent of the visbreaking heater. Quench is shown on the Figure at page 22 of *The Encyclopedia of Chemical Technology,* 2nd. Ed., vol. 15, 1968. The quench material illustrated is a light gas oil removed as a side-cut distillate from a fractionation section located above the primary flash zone and is therefore derived from vapors formed in the primary flash zone. A light gas oil is used in the similar process shown at page 154 of the September, 1968 edition of *Hydrocarbon Processing.* A different visbreaking process is shown at page 112 of the September, 1976 edition of *Hydrocarbon Processing.* In this process a heavy gas oil removed from the fractionation section located above the primary flash zone is used as quench.

It is also known in the art to pass the bottoms stream of the primary flash zone into a secondary flash zone. The bottoms material of this zone, often referred to as the residue of the process, has been used as quench material for the visbreaker effluent.

BRIEF SUMMARY OF THE INVENTION

The invention provides a process for the mild thermo treating of heavy oil fractions. In the process the heavy oil is passed through a visbreaker heater at visbreaking conditions and then cooled by admixture with a quench stream. The resultant admixture is passed into a rectified flash zone, and the bottoms stream of this zone is then flashed in a secondary flash zone. A liquid formed by the condensation of the overhead vapors of the secondary flash zone is used as the quench stream. This liquid differs from that used in the prior art in that it is neither a distillate formed from vapors of the first flashing step nor an asphaltene-rich residual material. It therefore is not as heavy and viscous as the prior art residual material or as likely to vaporize during the quenching operation as the prior art light material.

DESCRIPTION OF THE DRAWING

The Drawing is a simplified schematic of the preferred embodiment of the invention. Various subsystems and apparatus necessary to perform the process, such as pumps, valves, fractionation trays, condensers, heat exchangers and control systems, have not been shown and may be of customary design and manufacture. The Drawing is not intended to unduly limit the scope of the invention or to exclude those normal modifications in apparatus and operation as are commonly made by those skilled in the art.

A feed stream of a reduced crude oil enters the process through line 1 and is preferably, but not necessarily, admixed with a stream of high pressure steam from line 2. The reduced crude charge stock is then passed into a visbreaking heater 4 via line 3. Mild thermal cracking of the reduced crude at visbreaking conditions produces a visbreaker effluent stream carried by line 5. This stream is cooled by admixture with a quench stream from line 15, and the visbreaker effluent continues through line 6. It is then further cooled by admixture with a second quench stream from line 26. The visbreaker effluent is then passed into a rectified flash tower 8 via line 7.

The visbreaker effluent stream is flashed into a vapor fraction and a liquid fraction in the flash tower. The liquid fraction is withdrawn as a bottoms stream in line 16 and passed into a secondary flash zone 17. A lower pressure maintained within the secondary flash zone causes the flashing of the entering material into a second pair vapor and liquid fractions. The resulting residual liquid fraction is removed in line 23 and cooled as in a steam generator not shown. It is then divided into a first portion used as the second quench stream of line 26 and a second portion removed as a product stream in line 24. This high viscosity material is blended with a light cycle oil from line 25 to form an acceptable fuel oil product stream.

The vapor fraction formed in the secondary flash zone is removed as an overhead vapor in line 18 and condensed in a cooling means not shown. The resulting liquid is collected in an overhead receiver 19 and withdrawn in line 20. A first portion is passed into the secondary flash zone and admixed with ascending vapors through line 21 and a spray device not shown. The remaining second portion of this liquid is passed through line 22 to provide at least a portion of the first quench stream of line 15. That is, all of the net overhead liquid of this zone is used as quench material.

The vapors formed in the rectified flash tower by flashing the visbreaker effluent stream are preferably contacted by a liquid spray. They then rise through a trap-out tray 13 into an upper rectification section of the flash tower. Liquid collected on the trap-out tray is removed in line 11. A first portion is diverted through line 10 to provide the liquid sprayed into the vapors through line 9. Additional amounts of this material may be passed through line 14 and admixed with the secondary flash zone overhead liquid as quench liquid. A second portion of the trap-out tray liquid is directed through line 12 and cooled in heat exchangers not shown. It is then passed into the rectified flash zone at a higher point to aid in the fractionation performed in the upper section of this zone.

An overhead vapor stream is removed from the rectified flash zone in line 27 and passed through a condenser not shown. The resultant hydrocarbon liquid is collected in receiver 28, from which uncondensed gases are withdrawn via line 35 and water is decanted through a line not shown. The hydrocarbon liquid is removed through line 29 and divided into a reflux stream carried by line 30 and a second stream passed into a stabilizer column 32 by line 31. This trayed fractionation column is operated under conditions effective to separate the incoming liquid into an off-gas stream comprising $C_1$–$C_4$ hydrocarbons removed in line 33 and a naphtha product stream removed in line 34. This separation is accomplished through the use of an external reflux system at the top of the column and a reboiler at the bottom of the column.

DETAILED DESCRIPTION

Those skilled in the art are well acquainted with the thermal processing operation commonly referred to as visbreaking. Therefore, a minimum of introduction as to the operation of the process is required. Visbreaking is basically performed to reduce the viscosity of various heavy petroleum-derived hydrocarbonaceous liquids in order that they meet the specifications set for various grades of fuel oil. Hydrogen is not admixed with the feed steam during a visbreaking operation. It is normal to also recover some lighter hydrocarbons which are naphtha produced by the thermal cracking operation and which may also be present in the feed stream to a limited extent. The visbreaking operation may be integrated with a vacuum fractionation column, and various other products including light and heavy gas oils may be produced.

The feed stream to a visbreaking operation normally comprises a heavy hydrocarbon stream, such as a topped crude oil or a vacuum reduced crude oil. It will typically have an API gravity, measured at 60° F., of less than 20.0°. When the charge stock is subjected to the appropriate ASTM distillation it will preferably have a 10% distillation point at a temperature above 250° C. Prior to processing, this heavy material may be blended with a lighter material, such as a light gas oil, to improve its flow characteristics and lower its viscosity. Although not required, steam is preferably admixed with the feed stream to minimize coking within the heater tubes of the downstream visbreaking furnace.

The charge stock is heated within the visbreaking zone sufficiently to effect a mild thermocracking. This zone is operated at visbreaking conditions which include a temperature within the broad range of from 425° C. to about 540° C. and preferably above 470° C. Visbreaking conditions also include a pressure of from about 5–150 psig., with the charge stock being subjected to these conditions for about 20 to 65 equivalent seconds. The exact conditions of temperature and pressure which are preferred will vary with such factors as the characteristics of the feed material and the degree of thermocracking desired. A cold oil velocity within the heater tubes in excess of about 10 feet per second is preferred.

The effluent stream of the visbreaking zone is then quenched, that is, it is cooled by admixture with a stream of a colder liquid. The flow rate and temperataure of the total quench material should be sufficient to reduce the temperataure of the visbreaking zone effluent by at least 30 Centigrade degrees. Quenching by more than 140 Centigrade degrees is normally not preferred. More than one liquid stream is often used to provide the required cooling.

In the subject process quenching of visbreaker effluent is accomplished, at least in part, through the use of a liquid hydrocarbon stream which is substantially free of the material which is vaporized in the initial flashing of the visbreaking zone effluent stream. This quench liquid therefore will not appreciably vaporize at the conditions existing immediately after the quenching operation. For this reason it will aid in controlling coke formation in the liquid phase. However, the subject quench liquid stream will also be material which has been vaporized at least once before in the process and therefore does not have the high concentration of the viscous heavy hydrocarbons and asphaltenes which is present in the residue remaining after the second flashing step. The quench liquid used in the subject process is therefore less viscous and serves to reduce the viscosity of the quenched effluent stream and aid its transfer to the rectified flash zone. This unique combination of quench liquid characteristics distinguishes the subject process from those of the prior art.

The quenched effluent of the visbreaking zone is directed into the bottom, void section of a rectified flash zone at a point some distance above the bottom of the zone. This zone is operated at a pressure of about 45–150 psig. and at a bottom temperature of within the range of about 365° C. to 460° C. Preferably, the pressure is above 60 psig. As used herein, specified pressures refer to the pressure found at the top of the vessel and temperatures refer to the bottom temperature of the vessel under consideration. A liquid phase is collected in the bottom of the zone below the feed point and removed as a bottoms stream. The rectified flash zone is to have means to supply adequate cooling to the top section of the zone to condense sizable amounts of liquid and effect countercurrent vapor-liquid flow. The upper rectification section is preferably separated from the lower vapor section by a trap-out tray and the upper section preferably contains at least five fractionation trays and is fed reflux liquid at the top tray. A liquid stream removed at the trap-out tray may be cooled and returned to the upper section at a higher point which is intermediate two fractionation trays to aid the separatory operation.

The bottoms stream of the rectified flash zone is passed into a secondary flash zone. This is basically a void vessel having an upper vapor outlet and adapted to retain a liquid level below the feed point. A liquid is preferably sprayed into the vessel at a central location above the feed point. The secondary flash zone is operated at a lower pressure than the rectified flash zone. A broad range of temperatures for use in this zone is from about 350° to about 455° C. The pressure in this zone should be at least 30 psig. below that at which the bottom section of the rectified flash zone is operated. A range of pressures for this zone includes pressures from about 0 to 100 psig.

The invention may be further illustrated by this summary of the operation of a commercial scale unit similar to that shown in the Drawing. The feed stream is the residual oil which is formed in a propane deasphalting type operation and has an API gravity of 1.3°. This feed stream has a flow rate of approximately 18,400 BPSD (barrels per stream day) and is blended with sufficient light cycle oil to produce a stream of 4.8 °API material. This 23,000 BPSD stream is heated to 177° C. and then passed into a visbreaker heater maintained at visbreaking conditions. Provision is made to charge 600 psig. steam to the heater during periods of reduced charge rate. The visbreaker effluent stream is a mixed phase stream containing gases such as hydrogen sulfide, steam, methane, propane and higher carbon number hydrocarbons. The effluent stream contains about 590 mph (moles per hour) of vapor and 330 mph of liquid. Of this about 120 mph may be classified as $C_5$ to 177° C. material suitable for use as gasoline.

The visbreaker effluent stream is then quenched by admixture with three different liquid streams. The primary quench liquid is a stream of overhead liquid from the secondary flash zone having a flow rate of about 4,000 BPSD and a temperature of approximately 49° C. The other two quench streams are approximately 2,000 BPSD of 282° C. light oil removed from the rectified flash zone and about 1,800 BPSD of 218° C. bottoms material from the secondary flash zone. The visbreaker effluent stream is then passed into the lower section of the rectified flash tower.

About 1200 mph of vapors rise out of the lower section of the rectified flash tower into the upper rectification section. This vapor stream is formed in part by partial vaporization of a 282° C. liquid spray having a flow rate of about 10,150 BPSD. This liquid spray is derived from liquid removed at the trap-out tray sidedraw and is at approximately the same temperature as this liquid. The upper rectification section of this tower contains 16 fractionation trays. The sidedraw liquid has a flow rate of about 31,600 BPSD. About 19,500 BPSD of this liquid is cooled to about 190° C. and returned to the column at an intermediate point, that is, an elevation intermediate two fractionation trays.

The overhead vapors of the rectified flash tower have a temperature of approximately 177° C. They are cooled to about 43° C. in a condenser and separated into a gas stream and a hydrocarbon liquid. The gas stream is removed at the rate of approximately 150 mph and has an average molecular weight of 28. A first portion of the hydrocarbon liquid is used as reflux, and the remaining portion is passed into the stabilizer at the rate of approximately 150 mph. This column is operated as a debutanizer and contains 30 fractionation trays. It is operated with a bottoms temperature of about 190° C. and a top pressure of approximately 130 psig. About 120 mph of a naphtha suitable for use as a gasoline blending component is removed as a bottoms product. The remaining overhead off-gas contains methane, ethane, propane and butane as well as a small amount of hydrogen sulfide. This gas stream has an average molecular weight of about 45.

The bottoms stream of the rectified flash zone has a flow rate of about 27,700 BPSD and an API gravity of about 7.3°. It is passed into the secondary flash zone. About 21,800 BPSD of 5.1 °API residual material is removed from this zone as a net bottoms stream. This heavy material is blended with a sufficient quantity of a light cycle oil to produce a 7.5 °API fuel oil product. The overhead vapor stream of the secondary flash zone has a flow rate of about 760 mph. It is cooled to approximately 49° C. to effect its condensation. A first portion is utilized as a liquid sprayed into the secondary flash zone, and the remaining portion of this 22 °API liquid is utilized as a quench stream in accordance with the inventive concept.

I claim as my invention:

1. A process for thermally treating a heavy hydrocarbonaceous charge stock which comprises the steps of:

(a) passing a feed stream comprising petroleum derived hydrocarbonaceous compounds having an API gravity of less than 20.0° and having a 10% distillation temperature over 250° C. through a visbreaking heater operated at visbreaking conditions, and effecting the cracking of hydrocarbonaceous compounds and the production of a visbreaker effluent stream;

(b) cooling the visbreaker effluent stream at least 30 Centigrade degrees by admixing the visbreaker effluent stream with a quench stream;

(c) passing the visbreaker effluent stream into a rectified flash zone operated with a bottom temperature within the range of 365° C. to 460° C. and a pressure of from 45 psig. to 150 psig.;

(d) withdrawing a distillate sidecut stream from the rectified flash zone at a first intermediate point and returning at least a portion of the distillate sidecut stream to the rectified flash zone at a second, higher intermediate point;

(e) withdrawing an overhead vapor stream from the rectified flash zone, condensing at least a portion of the overhead stream to form a first overhead liquid, and passing a stream of the first overhead liquid into a fractionation column;

(f) withdrawing a liquid bottoms stream from the rectified flash zone, and flashing the liquid bottoms stream in a secondary flash zone maintained at flashing conditions including a pressure at least 30 psig. less than that maintained in the rectified flash zone;

(g) withdrawing a residue liquid stream from the bottom of the secondary flash zone, and removing at least a portion of the residue liquid stream from the process as a product; and (h) condensing overhead vapors removed from the secondary flash zone to form a second overhead liquid having a temperature less than 150° C., passing a first stream of the second overhead liquid into the secondary flash zone and admixing a second stream of the second overhead liquid with a portion of the distillate sidecut stream as the quench stream of step (b).

2. The process of claim 1 wherein the visbreaker effluent stream is also cooled by admixture with a portion of the residue liquid stream.

3. The process of claim 2 wherein the stream of the first overhead liquid which is passed into the fractionation column is separated therein into a naphtha bottoms stream and an overhead stream vapor stream comprising $C_1$–$C_4$ hydrocarbons.

* * * * *